US011189951B2

(12) United States Patent
Endo et al.

(10) Patent No.: US 11,189,951 B2
(45) Date of Patent: Nov. 30, 2021

(54) CONNECTOR

(71) Applicant: Yazaki Corporation, Tokyo (JP)

(72) Inventors: Tomomi Endo, Makinohara (JP); Koutarou Tobino, Fujieda (JP)

(73) Assignee: Yazaki Corporation, Tokyo (JP)

( * ) Notice: Subject to any disclaimer, the term of this patent is extended or adjusted under 35 U.S.C. 154(b) by 105 days.

(21) Appl. No.: 16/791,434

(22) Filed: Feb. 14, 2020

(65) Prior Publication Data

US 2020/0295493 A1 Sep. 17, 2020

(30) Foreign Application Priority Data

Mar. 15, 2019 (JP) ..... JP2019-048866

(51) Int. Cl.
*H01R 13/424* (2006.01)

(52) U.S. Cl.
CPC ..... *H01R 13/424* (2013.01)

(58) Field of Classification Search
CPC ..... H01R 13/424–4368
USPC ..... 439/752
See application file for complete search history.

(56) References Cited

U.S. PATENT DOCUMENTS 6,261,133 B1 * 7/2001 Kubo ..... H01R 13/4362 439/595
7,044,808 B1 * 5/2006 Foltz ..... H01R 13/4362 439/752
7,661,999 B2 * 2/2010 Horiuchi ..... H01R 13/506 439/752
7,988,502 B2 8/2011 Nagano et al.
8,727,816 B2 * 5/2014 Takahashi ..... H01R 13/4361 439/752
9,106,000 B2 * 8/2015 Mizutani ..... H01R 13/5219
9,666,970 B2 5/2017 Kida
9,859,645 B2 1/2018 Ohfuku et al.
2004/0132351 A1 * 7/2004 Miyakawa ..... H01R 13/4361 439/752
2007/0141905 A1 6/2007 Takeda et al.
2007/0141921 A1 6/2007 Mizutani et al.
2010/0068911 A1 3/2010 Nagano et al.
(Continued)

FOREIGN PATENT DOCUMENTS

JP 2003-115344 A 4/2003
JP 2007-184188 A 7/2007
(Continued)

*Primary Examiner* — Edwin A. Leon
*Assistant Examiner* — Milagros Jeancharles
(74) *Attorney, Agent, or Firm* — Banner & Witcoff, Ltd.

(57) ABSTRACT

A connector includes a cylindrical connector housing having a retainer and a terminal accommodating chamber in which a terminal is to be inserted. The retainer has first and second flat plate portions, a side plate portion, and a front plate portion. The retainer is attached to the cylindrical connector housing along an attaching direction. An engagement portion is provided on a side end edge of the first flat plate portion along the insertion direction of the terminal, and is engaged with an engagement projection provided on a housing outer surface of the cylindrical connector housing. A releasing jig insertion hole is provided on the first flat plate portion. The releasing jig insertion hole has, with respect to the housing outer surface, a releasing jig insertion hole angle that is larger than a releasing jig insertion portion angle of the releasing jig.

4 Claims, 9 Drawing Sheets

(56) References Cited

U.S. PATENT DOCUMENTS

| | | | |
|---|---|---|---|
| 2017/0025780 | A1 | 1/2017 | Kida |
| 2017/0069983 | A1 | 3/2017 | Ohfuku et al. |
| 2020/0203888 | A1 | 6/2020 | Ohfuku et al. |

FOREIGN PATENT DOCUMENTS

| | | | |
|---|---|---|---|
| JP | 2010-073375 | A | 4/2010 |
| JP | 2015-195124 | A | 11/2015 |
| JP | 2017-054674 | A | 3/2017 |
| WO | 2019/045038 | A1 | 3/2019 |

* cited by examiner

CONNECTOR

CROSS REFERENCE TO RELATED APPLICATIONS

This application is based on Japanese Patent Application (No. 2019-048866) filed on Mar. 15, 2019, the contents of which are incorporated herein by reference.

BACKGROUND OF THE INVENTION

1. Field of the Invention

The present invention relates to a connector.

2. Description of the Related Art

There is a connector that retains a terminal in a terminal accommodating chamber of a connector housing by attaching a retainer at a side of the connector housing having the terminal accommodating chamber that accommodates the terminal (see, for example, JP-A-2017-54674, JP-A-2015-195124 and JP-A-2010-73375).

After the retainer is attached to the connector housing, for example, there is a case where the terminal accommodated in the terminal accommodating chamber needs to be replaced due to a failure or the like at a connection location between the terminal and an electric wire. In this case, it is necessary to remove the retainer retaining the terminal in the terminal accommodating chamber from the connector housing.

In order to remove the retainer from the connector housing, it is necessary to insert a jig into a gap between the connector housing and the retainer to release an engagement state of an engagement portion of the retainer with respect to the connector housing. However, the retainer and the connector housing may be damaged by forcibly inserting the jig into the gap between the connector housing and the retainer.

SUMMARY OF THE INVENTION

The invention has been made in view of the above circumstances, and an object of the invention is to provide a connector in which a retainer can be reliably attached to a connector housing, and the attached retainer can be removed without difficulty.

The above-described object of the present disclosure is achieved by below-described structures.

(1) A connector including:

a cylindrical connector housing having a terminal accommodating chamber in which a terminal is to be inserted; and a retainer having:

first and second flat plate portions that face each other;

a side plate portion and a front plate portion that support the first and second flat plate portions, wherein:

the retainer is attached to the cylindrical connector housing along an attaching direction that intersects an insertion direction of the terminal into the terminal accommodating chamber so that the first and second flat plate portions sandwich the cylindrical connector housing from above and below and the retainer retains the terminal accommodated in the terminal accommodating chamber;

an engagement portion is provided on a side end edge of the first flat plate portion along the insertion direction, and is engaged with an engagement projection provided on a housing outer surface of the cylindrical connector housing by sliding the retainer in the attaching direction along the housing outer surface of the cylindrical connector housing;

a releasing jig insertion hole is provided at a tip end portion of the first flat plate portion in the attaching direction, and is configured to receive an insertion of a releasing jig that releases the engagement of the engagement portion with the engagement projection; and the releasing jig insertion hole has, with respect to the housing outer surface, a releasing jig insertion hole angle that is larger than a releasing jig insertion portion angle of the releasing jig.

(2) For example, when the retainer is attached to the cylindrical connector housing, the releasing jig insertion hole has a releasing jig insertion portion space that is defined between an inner end of the releasing jig insertion hole and a tip end surface of the engagement projection.

(3) For example, a temporary engagement projection is arranged in parallel with the engagement projection and is provided on the housing outer surface so as to extend further than the engagement projection in a direction substantially perpendicular to the attaching direction.

(4) For example, an upper face of the engagement projection is exposed to outside through the releasing jig insertion hole.

(5) For example, the releasing jig insertion hole has an inner inclined surface portion, and the releasing jig insertion hole angle is formed by the housing outer surface and the inner inclined surface portion.

According to the connector having the above configuration (1), the retainer can be reliably attached to the connector housing by engaging the engagement portion provided on one flat plate portion of the retainer with the engagement projection provided on the housing outer surface of the connector housing.

In addition, by inserting the releasing jig from the releasing jig insertion hole provided at the tip end portion of the one flat plate portion in the attaching direction of the retainer, the engagement of the engagement projection with the engagement portion on the flat plate portion is released, so that the retainer can be removed from the connector housing without difficulty.

Further, the releasing jig insertion hole has the releasing jig insertion hole angle (an angle formed by an inner inclined surface portion inclined toward the housing outer surface with respect to a parallel surface parallel to the housing outer surface) that is larger than the releasing jig insertion portion angle (a cutting edge angle of the tip end portion of the releasing jig) of the releasing jig.

Therefore, the tip end portion of the releasing jig inserted into the releasing jig insertion hole in order to release the engagement state of the engagement portion with respect to the engagement projection can easily enter between the one flat plate portion and the engagement projection, and an insertion property is improved. That is, there is no need to insert the tip end portion between the flat plate portion and the engagement projection while lifting up the tip end portion of the releasing jig inserted into the releasing jig insertion hole to push up one flat plate portion, and the tip end portion can be inserted between the inner surface of the flat plate portion and the engagement projection only by inserting the tip end portion of the releasing jig into the releasing jig insertion hole. Accordingly, it is possible to prevent damage to the retainer and the connector housing caused by pushing up or pushing down the releasing jig when the tip end portion inserted into the releasing jig insertion hole is inserted between the inner surface of one flat plate portion and the engagement projection to release the engagement of the engagement portion with respect to the engagement projection.

Further, since the front end portions of the retainer formed in a substantially U shape in a cross-sectional view by the pair of flat plate portions and the side plate portion are connected by the front plate portion, a rigidity of the retainer is enhanced by the front plate portion. Accordingly, it is possible to prevent deformation of the retainer when the retainer is removed from the connector housing by the releasing jig.

Therefore, according to the connector of the present configuration, the terminal accommodated in the terminal accommodating chamber can be easily replaced, and a burden on an operator can be reduced.

According to the connector having the above configuration (2), only by inserting the tip end portion of the releasing jig inserted into the releasing jig insertion hole into the releasing jig insertion portion space defined between the inner end (a rear end of the inner inclined surface portion in the attaching direction) of the releasing jig insertion hole and the tip end surface of the engagement projection, the tip end portion can easily reach between the inner surface of one flat plate portion and the engagement projection. Accordingly, the tip end portion can be inserted between the inner surface of the flat plate portion and the tip end surface of the engagement projection, only by inserting the tip end portion of the releasing jig into the releasing jig insertion hole, to easily release the engagement of the engagement portion with respect to the engagement projection.

According to the connector having the above configuration (3), the tip end portion of the releasing jig inserted into the releasing jig insertion hole in order to release the engagement state of the engagement portion with respect to the engagement projection can easily enter between the inner surface of one flat plate portion and the engagement projection, and there is no need to insert the tip end portion between the inner surface of the flat plate portion and the engagement projection while lifting up the tip end portion of the releasing jig inserted into the releasing jig insertion hole to push up one flat plate portion.

Therefore, since the tip end portion of the releasing jig inserted into the releasing jig insertion hole in order to release the engagement state of the engagement portion with respect to the engagement projection (main engagement projection) is not lifted up, the tip end portion easily hits the temporary engagement projection. Accordingly, it is possible to prevent the damage to the retainer or the connector housing caused by penetration of the tip end portion of the releasing jig that releases the engagement state of the engagement portion with respect to the engagement projection riding over the temporary engagement projection and inserting deeply.

According to the invention, it is possible to provide the connector in which the retainer can be reliably attached to the connector housing, and the attached retainer can be removed without difficulty.

The invention has been briefly described above. Further, details of the invention will be further clarified by reading through a mode (hereinafter referred to as "embodiment") for carrying out the invention described below with reference to the accompanying drawings.

BRIEF DESCRIPTION OF THE DRAWINGS

FIG. 6A is a cross-sectional view of the releasing jig immediately after insertion, FIG. 6B is a cross-sectional view of the releasing jig after insertion, and FIG. 6C is a cross-sectional view when an engagement is released by the releasing jig.

DETAILED DESCRIPTION OF THE EXEMPLARY EMBODIMENTS

Hereinafter, an embodiment of the invention will be described with reference to the drawings.

Figure 1:
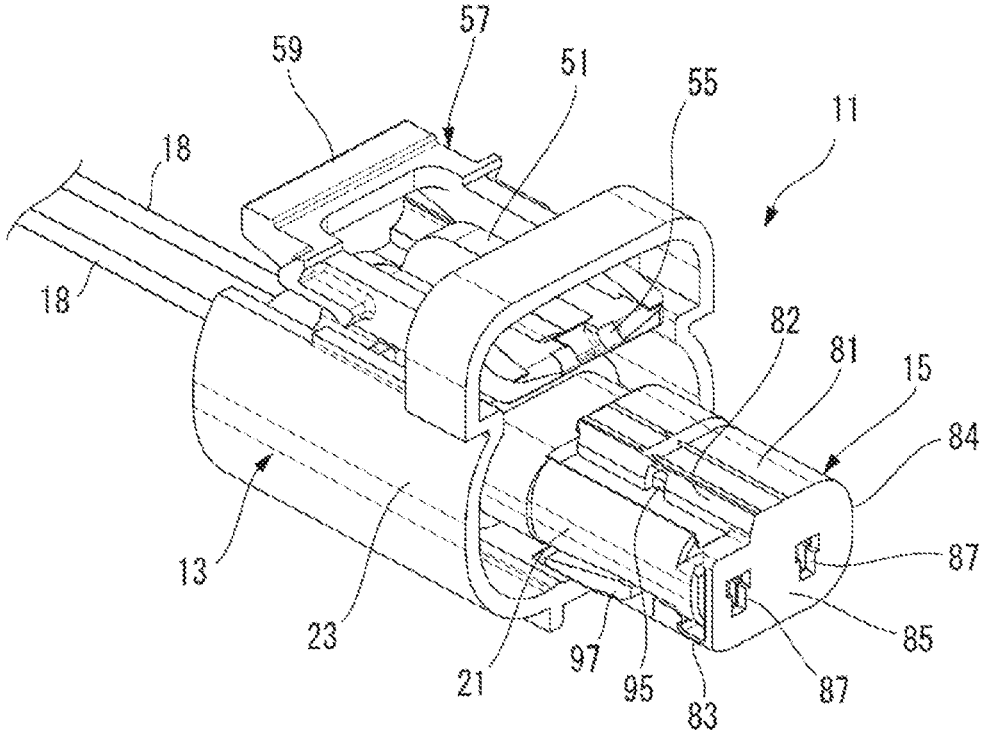
FIG. 1 is a perspective view of a connector according to an embodiment of the invention.
Figure 2:
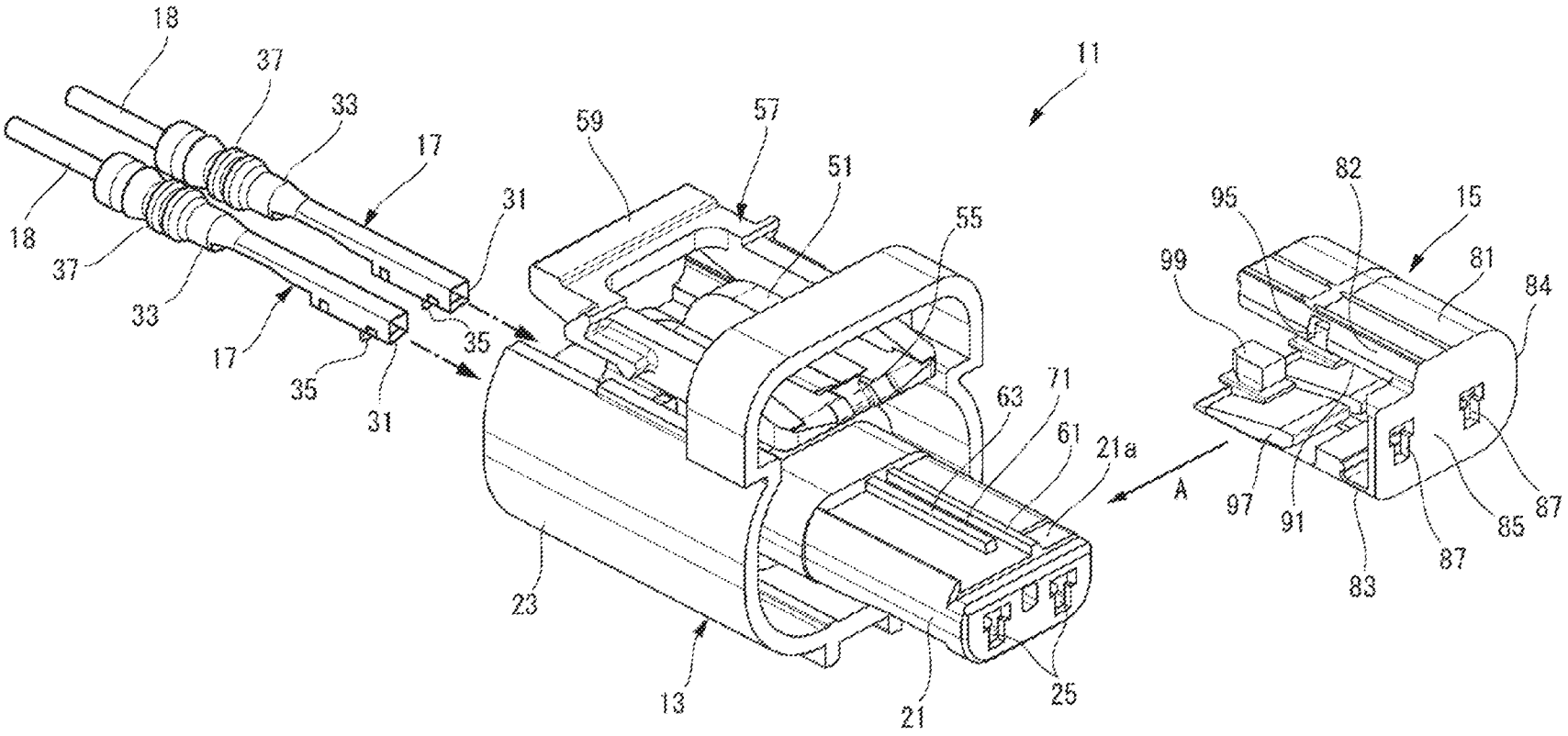
FIG. 2 is an exploded perspective view of the connector shown in FIG. 1.

FIG. 1 is a perspective view of a connector 11 according to an embodiment of the invention. FIG. 2 is an exploded perspective view of the connector 11 shown in FIG. 1.

As shown in FIGS. 1 and 2, the connector 11 includes a female housing 13 and a retainer 15 attached to the female housing 13. A female terminal (terminal) 17 is accommodated in the female housing 13. The connector 11 accommodates a pair of female terminals 17 in the female housing 13.

The female housing 13 is formed by connecting a cylindrical inner housing (connector housing) 21 and a cylindrical outer housing 23 surrounding an outer peripheral surface of the inner housing 21 with a space therebetween. The female housing 13 is made of a synthetic resin, and a hood portion of a male housing (not shown) is inserted into the space between the outer peripheral surface of the inner housing 21 and an inner peripheral surface of the outer housing 23.

The inner housing 21 has two terminal accommodating chambers 25 into which the female terminals 17 are to be inserted into a rear side of the inner housing 21. In each of the terminal accommodating chambers 25, a tip end portion of the inner housing 21 is opened to the outside, and a tab-shaped male terminal (mating terminal) (not shown) provided in the male housing is inserted from a tip end side of the inner housing 21.

The female terminals 17 inserted and accommodated in the terminal accommodating chambers 25 are connected to end portions of electric wires 18. The female terminals 17 include rectangular cylindrical-shaped electrical connecting portions 31 and electric wire connecting portions 33. The electrical connecting portions 31 are electrically connected to male terminals by inserting the male terminals into the electrical connecting portions 31. The electric wire connecting portions 33 are crimped to end portions of electric wires 18 and electrically connected to conductors of the electric wires 18. The electrical connecting portion 31 has an engagement piece portion 35 projecting from a lower portion of the electrical connecting portion 31. In addition, a rubber plug 37 is attached to the electric wire 18, to which the female terminal 17 is connected, at a connection end with the female terminal 17. In each of the terminal accommodating chambers 25, the rubber plug 37 is fitted into the terminal accommodating chamber 25 to seal between the electric wire 18 and the terminal accommodating chamber 25.

The inner housing 21 is formed to project forward relative to a front end surface of the outer housing 23. The retainer 15 is attached to a tip end portion of the inner housing 21 from a side. The inner housing 21 is fitted and connected to the male housing together with the retainer 15.

A housing arm 51 that can be elastically deformed is formed on an outer peripheral surface of the female housing 13. The housing arm 51 is formed in a U shape and is supported in a cantilevered manner on the outer peripheral surface of the female housing 13. The housing arm 51 has an engagement piece 55 that bridges front end portions in a width direction, and the engagement piece 55 is engaged with an engagement projection (not shown) formed on the male housing.

The housing arm 51 is configured such that the engagement piece 55 can swing with a rear end portion as a fulcrum. The housing arm 51 is connected to a U-shaped lock arm 57 supported in the cantilevered manner at a front end portion and extending toward a rear side. The lock arm 57 has an operation portion 59 that is pressed when an engagement state of the housing arm 51 is released.

As shown in FIG. 2, a temporary engagement projection 61 and a main engagement projection (engagement projection) 63 are provided on an upper surface 21*a* which is a housing outer surface of the inner housing (connector housing) 21 to which the retainer 15 is attached from the side. The temporary engagement projection 61 and the main engagement projection 63 are projecting ribs extending in parallel along an insertion direction of the female terminal 17. The temporary engagement projection 61 and the main engagement projection 63 are sequentially formed and arranged in parallel to each other and arranged along a direction substantially perpendicular to an attaching direction A (see FIG. 2) of the retainer 15. The upper surface 21*a* of the inner housing 21, on which the temporary engagement projection 61 and the main engagement projection 63 are formed, has a temporary engagement groove 71 between the temporary engagement projection 61 and the main engagement projection 63.

Figure 3A:
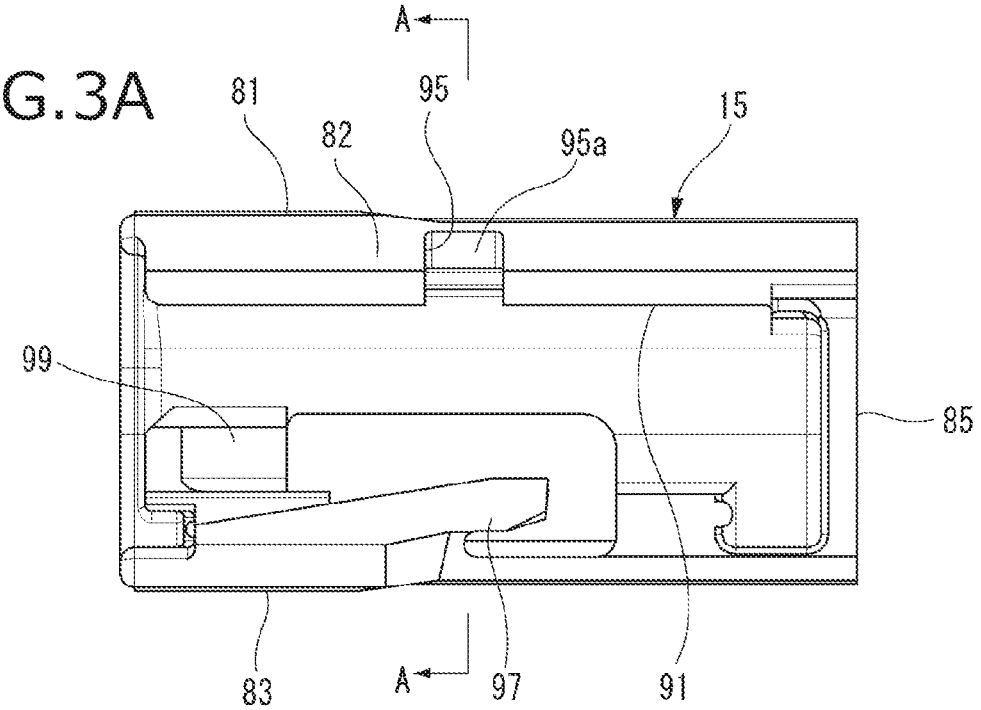
FIG. 3A is a side view of a retainer in the connector shown in FIG. 2.
Figure 3B:
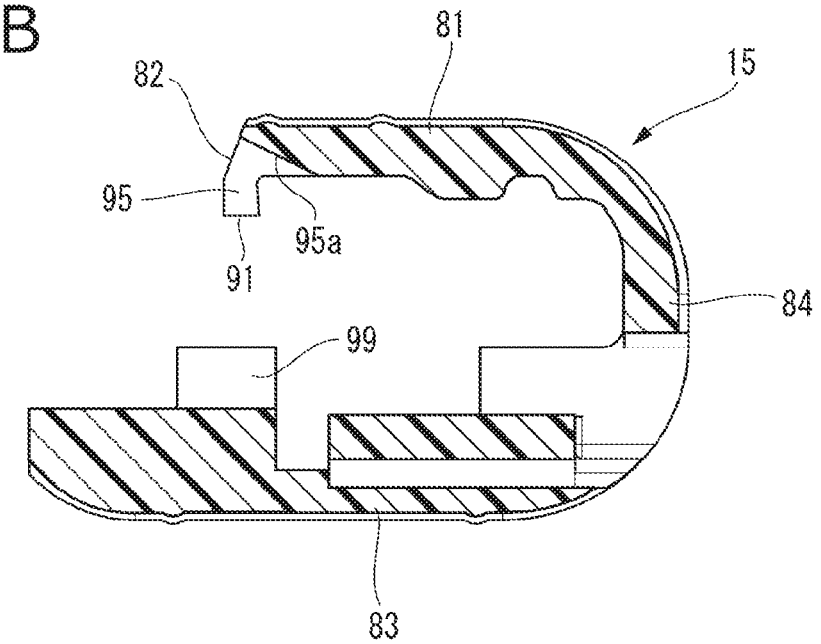
FIG. 3B is a cross-sectional view taken along an arrowed line A-A in FIG. 3A.

FIG. 3A is a side view of the retainer 15 in the connector 11 shown in FIG. 2, and FIG. 3B is a cross-sectional view taken along an arrowed line A-A in FIG. 3A.

As shown in FIGS. 2 and 3A to 3B, the retainer 15 is configured such that a pair of flat plate portions 81 and 83 facing each other are supported with a side plate portion 84 and a front plate portion 85. The retainer 15 is formed of a synthetic resin, and has side end portions of the pair of flat plate portions 81 and 83 which are connected by the side plate portion 84, and are formed in a substantially U shape in a cross-sectional view that open on one side in a width direction that is an attaching side to the inner housing 21, and front end portions are connected by the front plate portion 85. The retainer 15 is attached to the inner housing 21 from the attaching direction A that intersects the insertion direction of the female terminal 17 into the terminal accommodating chamber 25 so that the pair of flat plate portions 81 and 83 sandwich the inner housing 21 from above and below, and retains the female terminal 17 accommodated in the terminal accommodating chamber 25. Two insertion ports 87 are formed in the front plate portion 85 provided at a front end portion of the retainer 15. The insertion ports 87 communicate with the terminal accommodating chambers 25 of the inner housing 21 in a main engagement state in which the retainer 15 attached to the inner housing 21 is disposed at a main engagement position to be described later, and the male terminals are inserted from the insertion ports 87.

In the retainer 15, the engagement portion 91 is provided on a side end edge 82 along the insertion direction of the female terminal 17 that is an end edge of an opening side of the upper flat plate portion 81 that is one flat plate portion (see FIG. 3B). The engagement portion 91 projects from the upper flat plate portion 81 toward the lower flat plate portion 83, and is formed in a linear rib shape along a direction orthogonal to the attaching direction A of the retainer 15 to the inner housing 21. By sliding the retainer 15 in the attaching direction A along the upper surface 21*a* of the inner housing 21, the engagement portion 91 formed along a longitudinal direction of the retainer 15 is selectively engaged with the temporary engagement projection 61 or the main engagement projection 63. The retainer 15 is in a temporarily engagement state in which the engagement portion 91 is engaged with the temporary engagement projection 61 and is disposed in the temporary engagement groove 71. The retainer 15 is in the main engagement state in which the engagement portion 91 is engaged with the main engagement projection 63.

In addition, the retainer 15 has a releasing jig insertion hole 95. The releasing jig insertion hole 95 is formed for insertion of a releasing jig 101 to be described later, so that a notch is formed in the engagement portion 91. The releasing jig insertion hole 95 is formed at the side end edge 82 of the retainer 15, and is provided at a substantially central portion in the insertion direction of the female terminal 17 into the terminal accommodating chamber 25 in the upper flat plate portion 81.

Figure 4A:
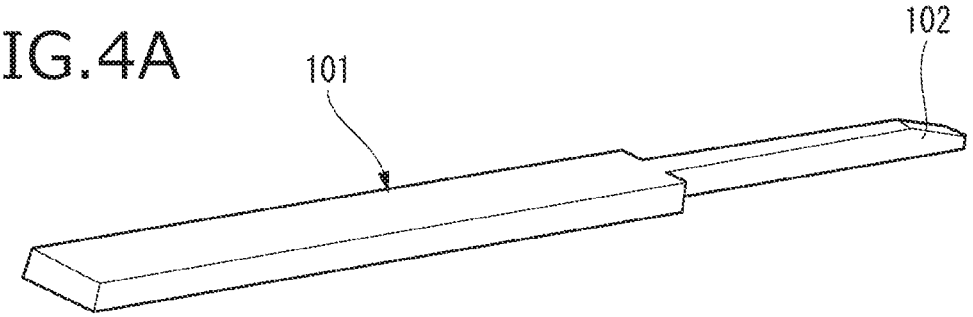
FIG. 4A is a perspective view of a releasing jig.
Figure 4B:
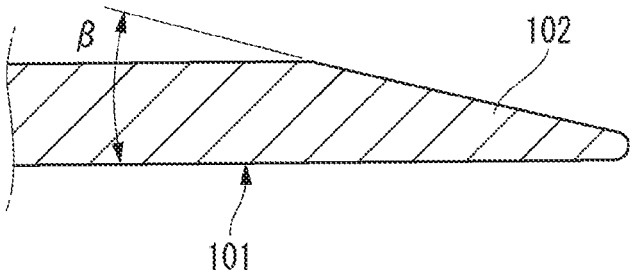
FIG. 4B is a longitudinal sectional view of a tip end portion of the releasing jig.
Figure 4C:
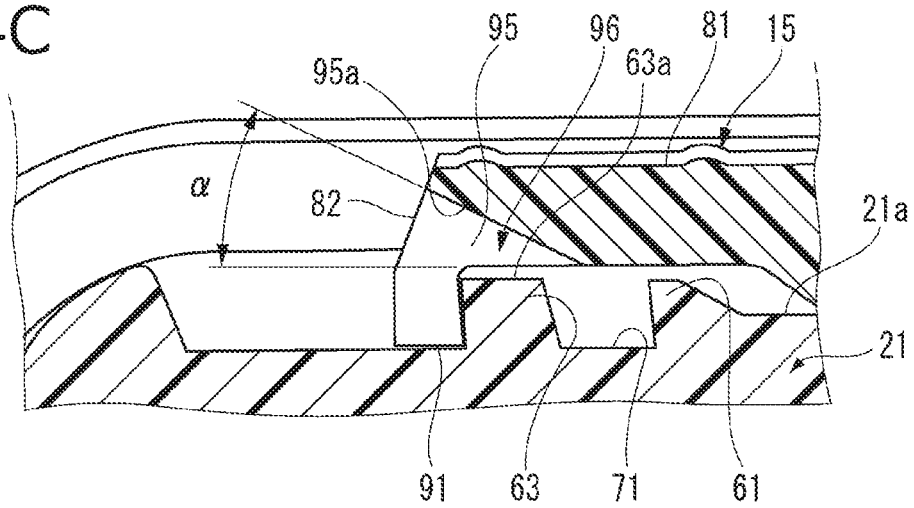
FIG. 4C is a cross-sectional view showing a location where the retainer is removed by the releasing jig according to the present embodiment.

FIG. 4A is a perspective view of the releasing jig 101, FIG. 4B is a longitudinal sectional view of a tip end portion 102 of the releasing jig, and FIG. 4C is a cross-sectional view showing a location where the retainer 15 is removed by the releasing jig 101 according to the present embodiment.

As shown in FIGS. 4A and 4B, the tip end portion 102 of the releasing jig 101 is formed into a wedge shape having a releasing jig insertion portion angle β. Here, the releasing jig insertion portion angle β is a cutting edge angle of the tip end portion 102 of the releasing jig 101.

As shown in FIG. 4C, the releasing jig insertion hole 95 of the retainer 15 has, with respect to a tip end surface 63*a* of the main engagement projection 63 which is a parallel surface parallel to the upper surface 21*a* of the inner housing 21, a releasing jig insertion hole angle α that is larger than the releasing jig insertion portion angle β of the tip end portion 102 of the releasing jig 101. Here, the releasing jig insertion hole angle α is an angle formed by an inner inclined surface portion 95*a* of the releasing jig insertion hole 95 inclined toward the upper surface 21*a* of the inner housing 21 with respect to a surface (for example, the tip end surface 63*a* of the main engagement projection 63) parallel to the upper surface 21*a*.

Further, as shown in FIG. 4C, when the retainer 15 is attached to the inner housing 21, in the releasing jig insertion hole 95 according to the present embodiment, a releasing jig insertion portion space 96 is defined between an inner end (middle, right end in FIG. 4C) of the releasing jig insertion hole 95 and the tip end surface 63*a* of the main engagement projection 63.

A lance (flexible engagement piece) 97 and a terminal engagement projection 99 projecting toward an inner side are formed on the lower flat plate portion 83 of the retainer 15. The lance 97 is provided in front of the terminal engagement projection 99 in the insertion direction of the female terminal 17 into the terminal accommodating chamber 25. A tip end of the lance 97 is inclined so as to project toward the upper flat plate portion 81 toward a front side in the insertion direction, and can be elastically deformed.

Next, a case in which the female terminal 17 is accommodated in the female housing 13 will be described.

First, the retainer 15 is attached to the inner housing 21 to be in the temporarily engagement state. Specifically, the retainer 15 is pushed in from the side of the inner housing 21 and moved in the width direction of the inner housing 21 (attaching direction A) so that the inner housing 21 enters a side opening portion of the retainer 15. When the retainer 15 is moved in the attaching direction A, the engagement portion 91 rides over the temporary engagement projection 61 and enters and is engaged with the temporary engagement groove 71. Accordingly, the retainer 15 is brought into the temporarily engagement state with respect to the inner housing 21. When the retainer 15 is brought into the temporarily engagement state with respect to the inner housing 21, the lance 97 of the retainer 15 is disposed in the terminal accommodating chamber 25.

The female terminal 17 to which the electric wire 18 is connected is inserted into the terminal accommodating chamber 25 of the female housing 13 from the rear side. The female terminal 17 is engaged by the engagement piece portion 35 riding over the lance 97, and maintained in an accommodated state in the terminal accommodating chamber 25.

Next, the retainer 15 in the temporarily engagement state is further pushed in, and slides in the attaching direction A. The engagement portion 91 rides over the main engagement projection 63 for engagement. Accordingly, the retainer 15 is brought into the main engagement state with respect to the inner housing 21. When the retainer 15 is brought into the main engagement state with respect to the inner housing 21, the terminal engagement projection 99 of the retainer 15 is disposed in the terminal accommodating chamber 25 together with the lance 97. Accordingly, the terminal engagement projection 99 enters a rear end side of the female terminal 17 engaged with the lance 97, and the female terminal 17 is engaged and retained by the lance 97 and the terminal engagement projection 99.

At this time, when the female terminal 17 inserted into the terminal accommodating chamber 25 is in a half-inserted state, the terminal engagement projection 99 of the retainer 15 interferes with the electrical connecting portion 31 of the female terminal 17. That is, when the female terminal 17 is in the half-inserted state, the retainer 15 in the temporarily engagement state cannot be pushed into the main engagement state, so that an operator can recognize that the female terminal 17 is in the half-inserted state.

As described above, the connector 11 according to the present embodiment is capable of detecting the female terminal 17 in the half-inserted state, and has a structure in which the lance 97 and the terminal engagement projection 99 are doubly engaged with the fully inserted female terminal 17.

Here, after the retainer 15 is attached to the inner housing 21, for example, there is a case where the female terminal 17 accommodated in the terminal accommodating chamber 25 needs to be replaced due to a failure or the like at the connection location between the female terminal 17 and the electric wire 18. In this case, it is necessary to remove the retainer 15 in which the female terminal 17 is doubly engaged in the accommodated state in the terminal accommodating chamber 25 from the inner housing 21.

Hereinafter, a case in which the retainer 15 is removed from the inner housing 21 will be described.

Figure 5:
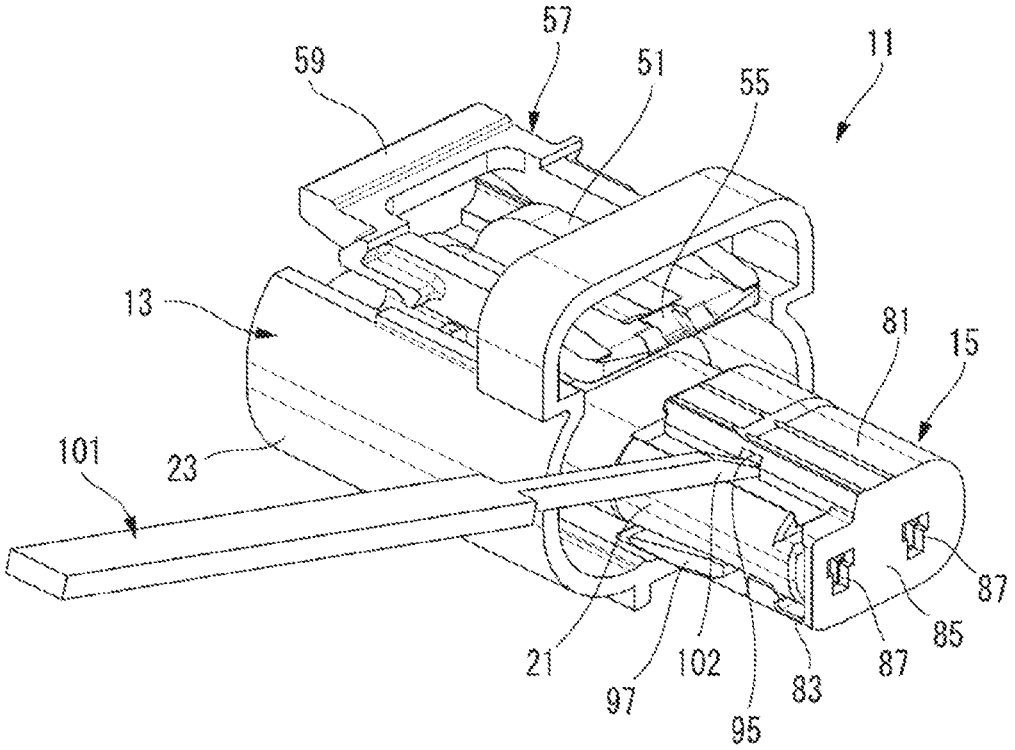
FIG. 5 is a perspective view of the connector according to the present embodiment for showing how to remove the retainer using the releasing jig.
Figure 6A:
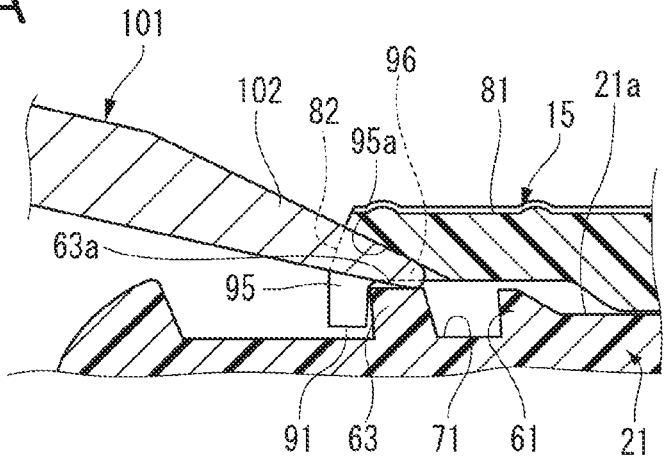
FIGS. 6A to 6C are views showing a location where the retainer is removed by the releasing jig according to the present embodiment.
Figure 6B:
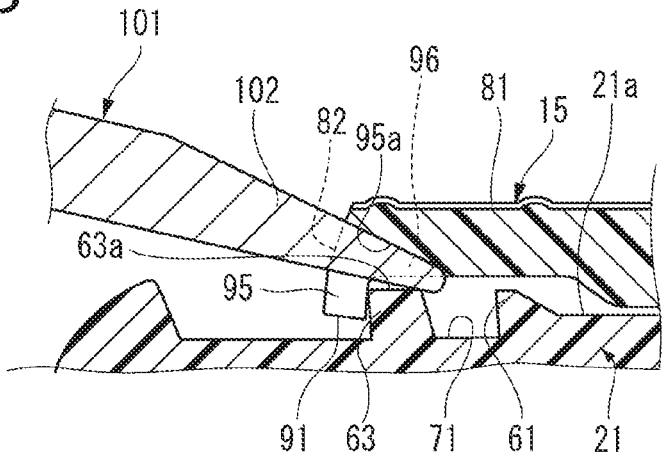
Figure 6C:
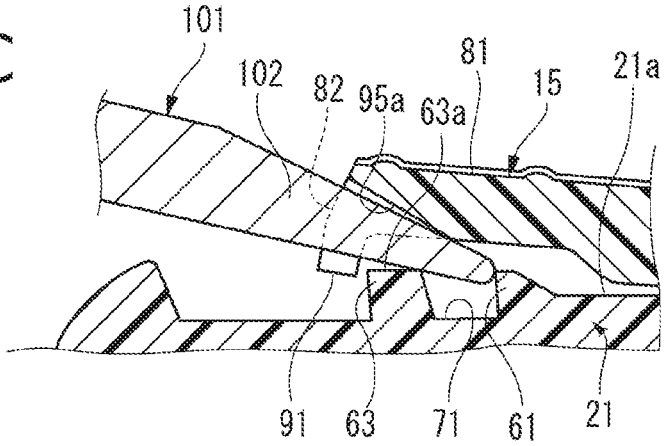

FIG. 5 is a perspective view of the connector 11 according to the present embodiment for showing how to remove the retainer 15 using the releasing jig 101. FIGS. 6A to 6C are views showing a location where the retainer 15 is removed by the releasing jig 101 according to the present embodiment, FIG. 6A is a cross-sectional view of the releasing jig 101 immediately after insertion, FIG. 6B is a cross-sectional view of the releasing jig 101 after insertion, and FIG. 6C is a cross-sectional view when the engagement is released by the releasing jig 101.

As shown in FIG. 6A, in the retainer 15 in the main engagement state with respect to the inner housing 21, the engagement portion 91 is engaged with the main engagement projection 63.

In order to remove the retainer 15 from the inner housing 21, a tip end portion, which is the tip end portion 102 of the rod-shaped releasing jig 101 having a tapered wedge shape, is inserted into the releasing jig insertion hole 95. Then, as shown in FIG. 6A, the tip end portion 102 of the releasing jig 101 is inserted into the releasing jig insertion portion space 96 defined between the inner end of the releasing jig insertion hole 95 and the tip end surface 63*a* of the main engagement projection 63.

As shown in FIG. 6B, the tip end portion 102 of the further inserted releasing jig 101 enters between the tip end surface 63*a* of the main engagement projection 63 and an inner surface of the upper flat plate portion 81, pushes up the upper flat plate portion 81 and separates the upper flat plate portion 81 from the inner housing 21. Then, the engagement state of the engagement portion 91 formed on the side end edge 82 of the upper flat plate portion 81 with respect to the main engagement projection 63 is released. When the engagement with the main engagement projection 63 is released, the engagement portion 91 of the retainer 15 rides over the main engagement projection 63 and enters the temporary engagement groove 71.

At this time, as shown in FIG. 6C, the tip end portion 102 of the releasing jig 101 that enters between the upper flat plate portion 81 and the main engagement projection 63 hits the temporary engagement projection 61, and enters the temporary engagement groove 71. Therefore, the upper flat plate portion 81 is not pushed up more than necessary by the releasing jig 101.

The lance 97 of the retainer 15 in the temporarily engagement state is bent toward an outside of the terminal accommodating chamber 25 by the tip end portion of the releasing jig 101, the engagement of the engagement piece portion 35 of the female terminal 17 is released, so that the female terminal 17 can be pulled out from the terminal accommodating chamber 25.

Further, when removing the retainer 15 from the inner housing 21, a rear end side of the releasing jig 101 whose the tip end portion 102 is inserted into the temporary engagement groove 71 from the releasing jig insertion hole 95 is pushed down. Thereby the tip end portion 102 of the releasing jig 101 is lifted up with an upper end of the main engagement projection 63 as a fulcrum, and the flat plate portion 81 is pushed up by the tip end portion 102 of the releasing jig 101 and is separated from the inner housing 21. Then, the engagement portion 91 formed on the side end edge 82 of the upper flat plate portion 81 is pulled out from the temporary engagement groove 71, and the engagement state of the engagement portion 91 with the temporary engagement projection 61 is released. By moving the retainer 15 in a direction reverse to that at the time of attaching the retainer 15 to the inner housing 21, the engagement portion 91 rides over the temporary engagement projection 61, and the retainer 15 is removed from the inner housing 21.

As described above, according to the connector 11 of the present embodiment, the retainer 15 can be reliably attached to the inner housing 21 by engaging the engagement portion 91 provided on the upper flat plate portion 81 of the retainer 15 with the main engagement projection 63 provided on the upper surface 21*a* of the inner housing 21.

In addition, by inserting the releasing jig 101 from the releasing jig insertion hole 95 provided at a tip end portion of the upper flat plate portion 81 in the attaching direction of the retainer 15, the engagement of the main engagement projection 63 or the temporary engagement projection 61 with the engagement portion 91 on the flat plate portion 81 is released, so that the retainer 15 can be removed from the inner housing 21 without difficulty.

Here, a connector according to a reference example will be described.

The same components as those of the connector 11 of the above embodiment are denoted by the same reference numerals, and a detailed description thereof is omitted.

Figure 7:
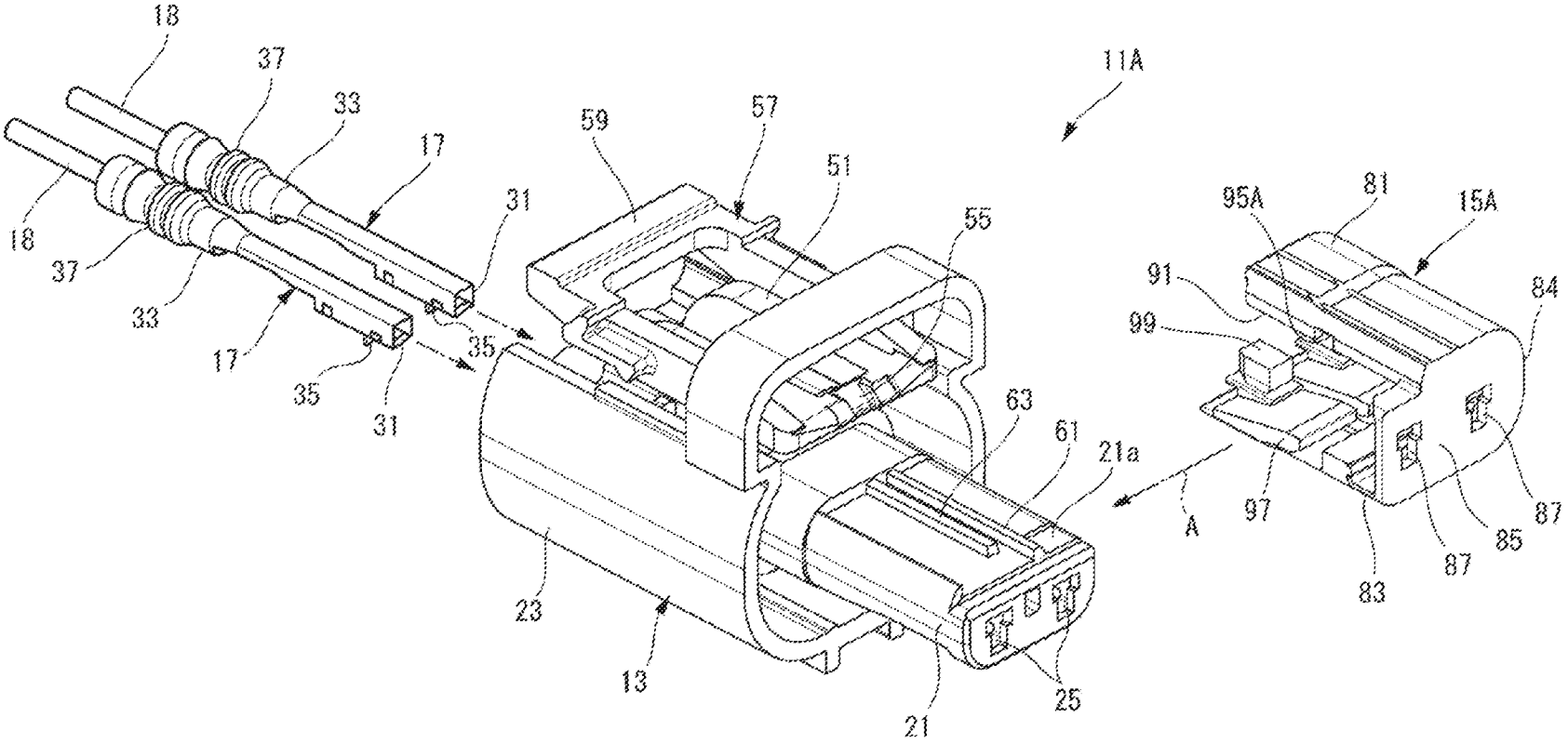
FIG. 7 is an exploded perspective view of a connector according to a reference example.
Figure 8A:
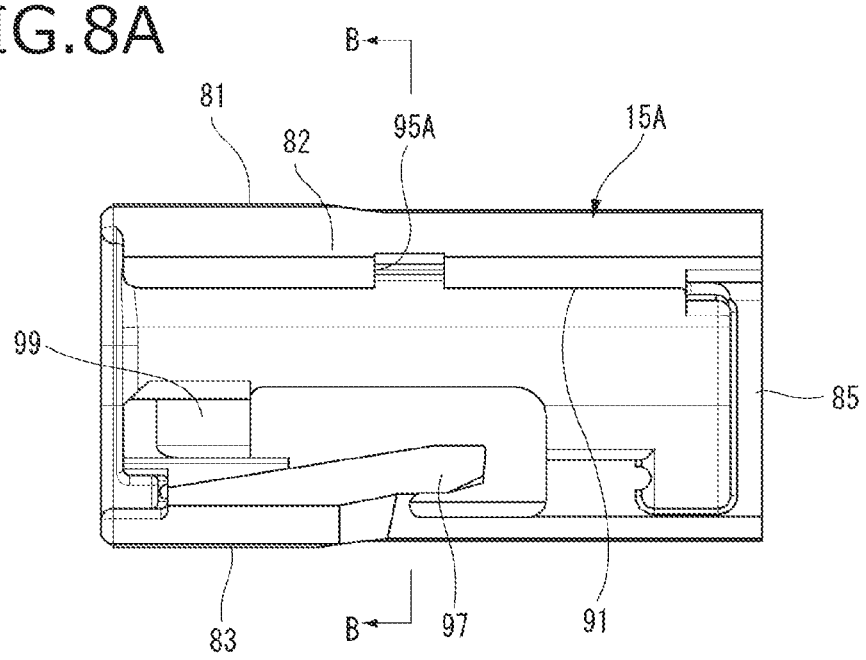
FIG. 8A is a side view of a retainer shown in FIG. 7.
Figure 8B:
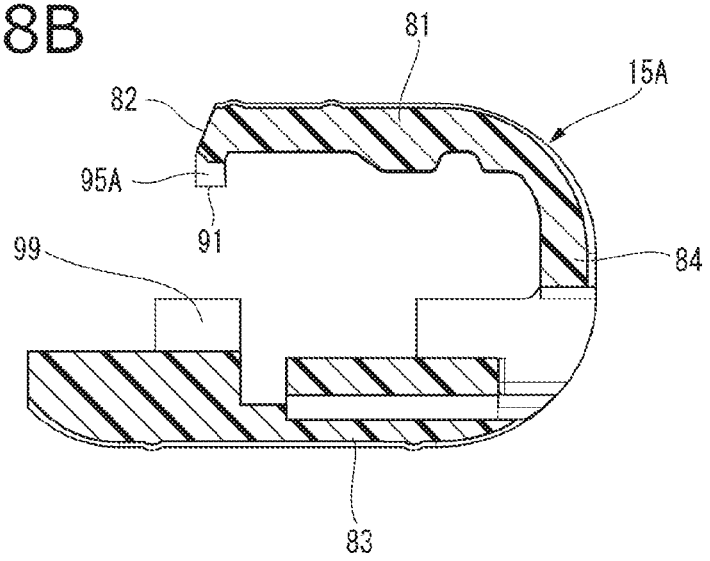
FIG. 8B is a cross-sectional view taken along an arrowed line B-B in FIG. 8A.
Figure 9A:
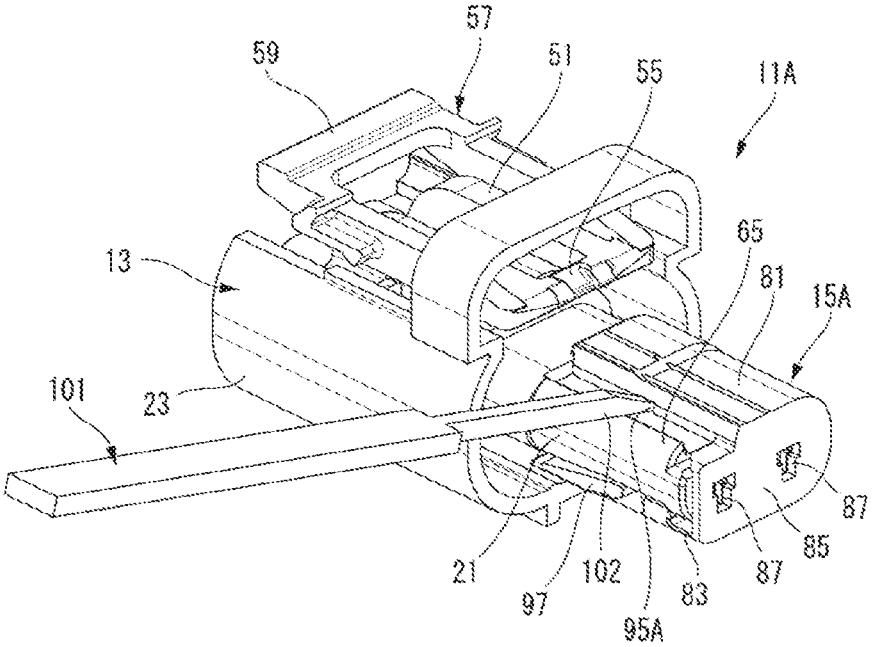
FIG. 9A is a perspective view of the connector according to the reference example for showing how to remove the retainer using the releasing jig.
Figure 9B:
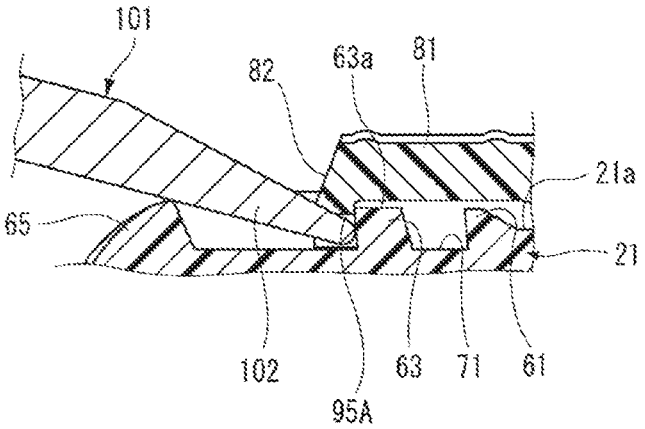
FIG. 9B is a cross-sectional view showing a location where the retainer according to the reference example is removed when the releasing jig is inserted.

FIG. 7 is an exploded perspective view of a connector 11A according to the reference example. FIG. 8A is a side view of a retainer 15A shown in FIG. 7, and FIG. 8B is a cross-sectional view taken along an arrowed line B-B in FIG. 8A. FIG. 9A is a perspective view of the connector 11A according to the reference example for showing how to remove the retainer using the releasing jig 101, and FIG. 9B is a cross-sectional view showing a location where the retainer 15A according to the reference example is removed when the releasing jig 101 is inserted.

As shown in FIGS. 7 to 8B, a releasing jig insertion hole 95A of the retainer 15A of the connector 11A according to the reference example does not have, with respect to the tip end surface 63*a* of the main engagement projection 63, the releasing jig insertion hole angle $\alpha$ that is larger than the releasing jig insertion portion angle $\beta$ of the tip end portion 102 of the releasing jig 101 like the releasing jig insertion hole 95 of the retainer 15 according to the above embodiment, and is smaller than the releasing jig insertion hole 95.

Then, in order to remove the retainer 15A from the inner housing 21, as shown in FIGS. 8A and 8B, the tip end portion 102 of the releasing jig 101 is inserted into the releasing jig insertion hole 95A. Then, the tip end portion 102 of the releasing jig 101 enters between the inner housing 21 and the upper flat plate portion 81 of the retainer 15A, and hits the main engagement projection 63.

In this state, when the rear end side of the releasing jig 101 is pushed down, the tip end portion of the releasing jig 101 is lifted up with respect to an upper end of a side wall portion 65 as a fulcrum, and the upper flat plate portion 81 is pushed up by the tip end portion 102 of the releasing jig 101 and is separated from the inner housing 21. Then, the engagement state of the engagement portion 91 formed on the side end edge 82 of the upper flat plate portion 81 with respect to the main engagement projection 63 is released.

As described above, it is necessary to insert, in the case of the connector 11A according to the reference example, when removing the retainer 15A from the inner housing 21, the tip end portion 102 between the flat plate portion 81 and the main engagement projection 63 while lifting up the tip end portion 102 of the releasing jig 101 inserted into the releasing jig insertion hole 95A to push up one flat plate portion 81, and the retainer 15A and the inner housing 21 may be damaged by pushing up or pushing down the releasing jig 101.

In addition, in the connector 11A according to the reference example, the tip end portion 102 of the releasing jig 101 inserted into the releasing jig insertion hole 95A to be lifted up to release the engagement state of the engagement portion 91 with respect to the main engagement projection 63 may ride over the temporary engagement projection 61 and be inserted deeply, thereby damaging the retainer 15A and the inner housing 21. In particular, when the releasing jig 101 is inserted deeply after riding over the temporary engagement projection 61, the upper flat plate portion 81 may be greatly pushed up and damaged.

On the other hand, according to the connector 11 of the present embodiment, the releasing jig insertion hole 95 has the releasing jig insertion hole angle $\alpha$ that is larger than the releasing jig insertion portion angle $\beta$ of the releasing jig 101, as shown in FIGS. 4B and 4C.

Therefore, the tip end portion 102 of the releasing jig 101 inserted into the releasing jig insertion hole 95 in order to release the engagement state of the engagement portion 91 with respect to the main engagement projection 63 can easily enter between the one flat plate portion 81 and the main engagement projection 63, and an insertion property is improved. That is, there is no need to insert the tip end portion 102 between the flat plate portion 81 and the main engagement projection 63 while lifting up the tip end portion 102 of the releasing jig 101 inserted into the releasing jig insertion hole 95 to push up one flat plate portion 81, and the tip end portion 102 can be inserted between the inner surface of the flat plate portion 81 and the main engagement projection 63 only by inserting the tip end portion 102 of the releasing jig 101 into the releasing jig insertion hole 95. Accordingly, it is possible to prevent damage to the retainer 15 and the inner housing 21 caused by pushing up or pushing down the releasing jig 101 when the tip end portion 102 inserted into the releasing jig insertion hole 95 is inserted between the inner surface of one flat plate portion 81 and the main engagement projection 63 to release the engagement of the engagement portion 91 with respect to the main engagement projection 63.

Further, since the front end portions of the retainer 15 formed in a substantially U shape in a cross-sectional view by the pair of flat plate portions 81 and 83 and the side plate portion 84 are connected by the front plate portion 85, a rigidity of the retainer 15 is enhanced by the front plate portion 85. Accordingly, it is possible to prevent deformation of the retainer 15 when the retainer 15 is removed from the inner housing 21 by the releasing jig 101.

In addition, according to the connector 11 of the present embodiment, only by inserting the tip end portion 102 of the releasing jig 101 inserted into the releasing jig insertion hole 95 into the releasing jig insertion portion space 96 defined between the inner end of the releasing jig insertion hole 95 and the tip end surface 63*a* of the main engagement projection 63, the tip end portion 102 can easily reach between the inner surface of one flat plate portion 81 and the main engagement projection 63. Accordingly, the tip end portion 102 can be inserted between the inner surface of the flat plate portion 81 and the tip end surface 63*a* of the main engagement projection 63, only by inserting the tip end portion 102 of the releasing jig 101 into the releasing jig insertion hole 95, to easily release the engagement of the engagement portion 91 with respect to the main engagement projection 63.

Further, according to the connector 11 of the present embodiment, the tip end portion 102 of the releasing jig 101 inserted into the releasing jig insertion hole 95 in order to release the engagement state of the engagement portion 91 with respect to the main engagement projection 63 can easily enter between the inner surface of one flat plate portion 81 and the main engagement projection 63, and there is no need to insert the tip end portion 102 between the inner surface of the flat plate portion 81 and the main engagement projection 63 while lifting up the tip end portion 102 of the releasing jig 101 inserted into the releasing jig insertion hole 95 to push up one flat plate portion 81.

Therefore, since the tip end portion 102 of the releasing jig 101 inserted into the releasing jig insertion hole 95 in order to release the engagement state of the engagement portion 91 with respect to the main engagement projection 63 is not lifted up, the tip end portion 102 easily hits the temporary engagement projection 61. Accordingly, it is possible to prevent the damage to the retainer 15 and the inner housing 21 caused by penetration of the tip end portion 102 of the releasing jig 101 that releases the engagement state of the engagement portion 91 with respect to the main engagement projection 63 riding over the temporary engagement projection 61 and inserting deeply.

Therefore, according to the connector 11 of the present embodiment, the female terminal 17 accommodated in the terminal accommodating chamber 25 can be easily replaced, and a burden on the operator can be reduced.

The invention is not limited to the embodiment described above, and modifications, improvements, and the like can be made as appropriate. In addition, material, shape, dimension, numerical value, form, number, arrangement locations, etc. of each constituent element in the above-described embodiment are optional as far as the invention can be achieved, and are not limited.

The characteristics of the embodiment of the connector according to the invention will be briefly summarized in the following [1] to [3].

[1] A connector (11) including:

a cylindrical connector housing (inner housing 21) having a terminal accommodating chamber (25) in which a terminal (female terminal 17) is to be inserted; and a retainer (15) having:

first and second flat plate portions (81, 83) facing each other;

a side plate portion 84 and a front plate portion 85 that support the first and second flat plate portions, wherein the retainer is attached to the cylindrical connector housing (inner housing 21) along an attaching direction (A) that intersects an insertion direction of the terminal into the terminal accommodating chamber so that the first and second flat plate portions (81, 83) sandwich the cylindrical connector housing (inner housing 21) from above and below and the retainer retains the terminal (female terminal 17) accommodated in the terminal accommodating chamber (25);

an engagement portion (91) is provided on a side end edge (82) of the first flat plate portion (81) along the insertion direction, and is engaged with an engagement projection (main engagement projection 63) provided on a housing outer surface (upper surface 21*a*) of the cylindrical connector housing by sliding the retainer (15) in the attaching direction (A) along the housing outer surface (upper surface 21*a*) of the cylindrical connector housing (inner housing 21);

a releasing jig insertion hole (95) is provided at a tip end portion of the first flat plate portion (81) in the attaching direction, and is configured to receive an insertion of a releasing jig (101) that releases the engagement of the engagement portion (91) with the engagement projection (main engagement projection 63); and the releasing jig insertion hole (95) has, with respect to the housing outer surface (upper surface 21*a*), a releasing jig insertion hole angle (α) that is larger than a releasing jig insertion portion angle (β) of the releasing jig (101).

[2] The connector (11) according to the above [1], in which when the retainer (15) is attached to the cylindrical connector housing (inner housing 21), the releasing jig insertion hole (95) has a releasing jig insertion portion space (96) that is defined between an inner end of the releasing jig insertion hole (95) and a tip end surface (63*a*) of the engagement projection (main engagement projection 63).

[3] The connector (11) according to the above [1] or [2], in which a temporary engagement projection (61) is arranged in parallel with the engagement projection (63) and is provided on the housing outer surface (upper surface 21*a*) so as to extend further than the engagement projection (main engagement projection 63) in a direction substantially perpendicular to the attaching direction (A).

[4] The connector (11) according to any one of the above [1] to [3], in which an upper face of the engagement projection (63) is exposed to outside through the releasing jig insertion hole (95).

[5] The connector (11) according to any one of the above [1] to [4], in which the releasing jig insertion hole (95) has an inner inclined surface portion (95*a*); and the releasing jig insertion hole angle is formed by the housing outer surface and the inner inclined surface portion (95*a*).

What is claimed is:

1. A connector comprising:

a cylindrical connector housing having a terminal accommodating chamber in which a terminal is to be inserted; and a retainer having:

first and second flat plate portions that face each other;

a side plate portion and a front plate portion that support the first and second flat plate portions, wherein:

the retainer is attached to the cylindrical connector housing along an attaching direction that intersects an insertion direction of the terminal into the terminal accommodating chamber so that the first and second flat plate portions sandwich the cylindrical connector housing from above and below and the retainer retains the terminal accommodated in the terminal accommodating chamber;

an engagement portion is provided on a side end edge of the first flat plate portion along the insertion direction, and is engaged with an engagement projection provided on a housing outer surface of the cylindrical connector housing by sliding the retainer in the attaching direction along the housing outer surface of the cylindrical connector housing;

a releasing jig insertion hole is provided at a tip end portion of the first flat plate portion in the attaching direction, and is configured to receive an insertion of a releasing jig that releases the engagement of the engagement portion with the engagement projection;

the releasing jig insertion hole has, with respect to the housing outer surface, a releasing jig insertion hole angle that is larger than a releasing jig insertion portion angle of the releasing jig;

a temporary engagement projection is arranged in parallel with the engagement projection;

the temporary engagement projection and the engagement projection are provided on the housing outer surface in this order in the attaching direction; and the temporary engagement projection extends further than the engagement portion in a direction substantially perpendicular to the attaching direction.

2. The connector according to claim 1, wherein:

when the retainer is attached to the cylindrical connector housing, the releasing jig insertion hole has a releasing jig insertion portion space that is defined between an inner end of the releasing jig insertion hole and a tip end surface of the engagement projection.

3. The connector according to claim 1, wherein:

an upper face of the engagement projection is exposed to outside through the releasing jig insertion hole.

4. The connector according to claim 1, wherein:

the releasing jig insertion hole has an inner inclined surface portion; and the releasing jig insertion hole angle is formed by the housing outer surface and the inner inclined surface portion.

* * * * *